US005394159A

United States Patent [19]

Schneider et al.

[11] Patent Number: 5,394,159

[45] Date of Patent: Feb. 28, 1995

[54] MICROSTRIP PATCH ANTENNA WITH EMBEDDED DETECTOR

[75] Inventors: Martin V. Schneider, Holmdel; Ralph F. Trambarulo, Red Bank; Cuong Tran, Howell, all of N.J.

[73] Assignee: AT&T Corp., Murray Hill, N.J.

[21] Appl. No.: 146,250

[22] Filed: Nov. 2, 1993

[51] Int. Cl.[6] ..... H01Q 1/38

[52] U.S. Cl. ..... 343/700 MS; 343/745

[58] Field of Search ..... 343/700 MS File, 745, 343/829, 830, 846, 722; H01Q 1/38

[56] References Cited

U.S. PATENT DOCUMENTS 4,529,987 7/1985 Bhartia et al. ..... 343/700 MS
4,777,490 10/1988 Sharma et al. ..... 343/700 MS
4,780,724 10/1988 Sharma et al. ..... 343/700 MS
4,918,749 4/1990 Entschladen et al. ..... 343/700 MS
5,068,669 11/1991 Koert et al. ..... 343/700 MS

OTHER PUBLICATIONS

Microstrip Antennas, D. M. Pozar, Proceedings of the IEEE, vol. 80, Jan. 1992, p. 79 et seq.

*Primary Examiner*—Donald Hajec
*Assistant Examiner*—Hoanganh Le

[57] ABSTRACT

A diode detector is integrated into a microstrip patch antenna. Tuning and matching of the detector are accomplished by adjusting the geometry of the patch. Cost, power consumption, losses, and spurious responses are reduced. The antenna may be adapted to a mixer, video detector, i.f. detector, or audio detector.

8 Claims, 4 Drawing Sheets

MICROSTRIP PATCH ANTENNA WITH EMBEDDED DETECTOR

BACKGROUND OF THE INVENTION

1. Field of the Invention

This invention pertains to radio antennas, particularly to microwave antennas, and most particularly to microstrip (or "patch") microwave antennas.

2. Reference

Microstrip Antennas, D. M. Pozar, Proceedings of the IEEE, Vol. 80 No. 1, January, 1992, page 79 et seq (hereinafter, "Pozar").

3. Description of the Related Art

The physical size of an antenna is proportional to the wavelength of the signal it is intended to transmit or receive. As higher frequencies, with their shorter wavelengths, have been exploited, smaller antennas have become possible. The exploitation of frequencies in the GHz. range has led to the development and use of the microstrip antenna, which Pozar describes as "a metallic patch printed on a thin, grounded dielectric substrate" (Pozar at page 79). Such antennas can be inexpensive and compact.

Such inexpensive and compact antennas, in turn, have led to a broadening of the field of devices in which radio communication is used, such as employee badges that transmit the employee's identity or electronic shelf labels that receive and display price information dynamically. Since such devices might be required in large quantities, it is desirable that each unit be inexpensive; since such devices must operate portably or remotely, it is desirable that they consume little power.

Prior-art devices incorporating microstrip antennas employ conventional means for connecting the antennas to receiving or transmitting apparatus; the present invention provides a detector integrated into the microstrip antenna, enabling video, if, af, or dc signal to be obtained directly from the patch. This enhances compactness and lowers the cost and power consumption.

SUMMARY OF THE INVENTION

It is thus a general object of the present invention to provide improved patch antennas.

It is a particular object of the present invention to provide patch antennas from which detected signal may be directly obtained.

It is a more particular object of the present invention to provide compact, inexpensive patch antennas from which detected signal may be directly obtained.

In accordance with the present invention, these objectives are achieved by a patch antenna having a diode detector integrated into the patch. The patch is physically constructed so as to tune the detector itself, or to tune the detecting antenna with adjacent components of the receiving or transmitting system.

The novel features of construction and operation of the invention will be more clearly apparent during the course of the following description and the appended drawings, wherein:

DESCRIPTION OF THE PREFERRED EMBODIMENTS

A patch antenna may be constructed of a conductive patch substantially parallel to and proximate to a conductive ground plane. The embodiments discussed herein realize this construction as metal foils "printed" on the two faces of a dielectric substrate, one foil being the patch and the other being the ground plane. Other realizations will be evident to those skilled in the art.

Figure 1:
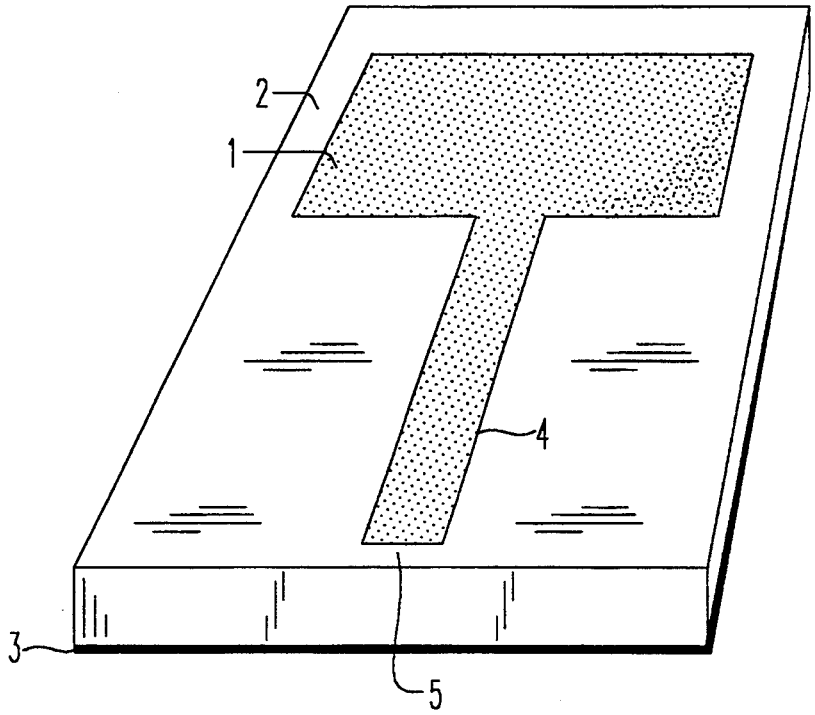
FIG. 1 (PRIOR ART)
FIG. 1 depicts a generic microwave strip antenna of the prior art.

A generic microwave strip antenna of the prior art is shown in FIG. 1: a metallic patch 1 is printed on a thin dielectric substrate 2; the back of the substrate bears a metallic coating 3. Integral to patch 1 is a transmission line 4, inset from the edge of the substrate by inset 5; the physical dimensions of transmission line 4 and inset 5 may be determined by one skilled in the art so as to present a desired impedance match to an external transmission line (not shown) to be connected to the antenna at the outer end of transmission line 4. Similarly, the dimensions of patch 1 may be determined so that the antenna is resonant at a desired operating frequency.

The substrate used for the prior-art embodiment discussed herein is Duroid (tm) with a dielectric constant $\epsilon_r$ of 2.2 and a thickness of 0.75 mm.

In an embodiment of this prior-art antenna, output was used as a one-port to connect to a Schottky diode detector (not shown) in order a obtain a rectified dc output signal proportional to the received microwave power. This requires a separate circuit with appropriate tuning elements for matching or mismatching the diode (according to whether the diode is to be used as an optimized detector or as a reflector, respectively). This approach requires additional space, increases the losses (ohmic conductor loss and dielectric substrate loss) and adds to fabrication cost. Furthermore, additional resonances may occur since the total microstrip conductor structure including the microstrip matching network can be considered as an extended patch radiator which, because of its extended dimension, can support multiple resonant modes.

Figure 2:
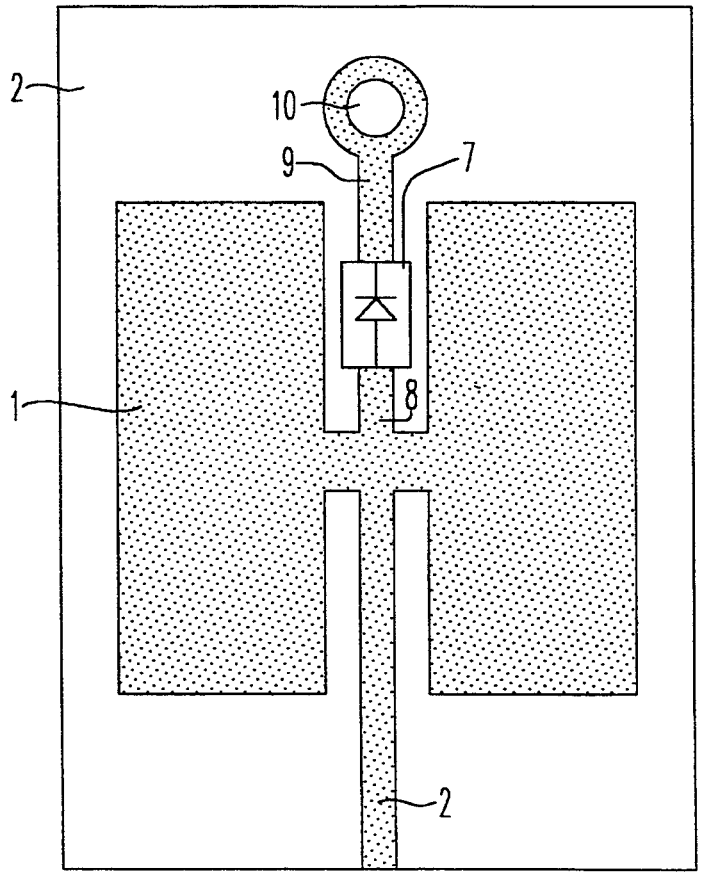
FIG. 2 shows a microwave strip antenna with an integrated diode detector according to the present invention.

FIG. 2 depicts an embodiment of the present invention, intended for use in an electronic shelf label (ESL) designed for application in a supermarket stocking several thousand items, each assigned a particular shelf location, that shelf location being provided with an ESL. A computer located on the premises is programmed to store the price of each item in such a manner that an operator may change any price. When the operator directs that the prices entered in the computer be transmitted to the shelf labels, the computer controls a low-power transmitter on the premises to transmit amplitude-modulated digital messages to the ESLs. Each message contains a code identifying a particular ESL; each ESL, upon recognizing its code, is conditioned to receive the rest of the message which consists of the price data the ESL is to display. The same computer informs electronic cash registers on the premises of the current prices.

In ESLs of the prior art, the microstrip antenna is connected to a conventional detector, from which the detected signal is forwarded to other circuitry, such as demodulators for recovering the said digital messages, decoders for recognizing codes, and registers for informing the price displays.

Each ESL includes a long-life battery. Economic considerations may dictate that the entire ESL be replaced at the end of battery life (the ESLs are so compact and integrated that it may be infeasible to replace components within them); an improvement that decreases battery drain will effect significant economic savings inasmuch as there are thousands of ESLs at each location.

Again because of the large number of ESLs at each location, an improvement that lowers unit cost will effect significant economic savings.

The present invention achieves both aims of lowering unit cost and decreasing battery drain by incorporating a diode detector directly into the microstrip antenna, eliminating the need for a conventional transistor-based detector. With reference to FIG. 2, a microstrip antenna patch 1 for use at 5.8 GHz. is printed on a face of substrate 2. (The other face of substrate 2, not shown in FIG. 2, is metallized with foil 3 just as substrate 2 of FIG. 1.) The antenna is in a butterfly configuration; projecting from a point within the patch is land 8, electrically continuous with antenna 1. Also printed on substrate 2 is land 9, not electrically continuous with antenna 1 or land 8; land 9 is connected through via 10 to said foil 3 on the other face of substrate 2, which foil is electrically grounded.

Surface-mount diode 7 is connected between land 8 and land 9. Diode 7 rectifies the signal current flowing in antenna 1, causing a detected (dc) signal to appear within the patch.

Diode 7 in the preferred embodiment is a Schottky detector, which possesses an inherent junction capacitance; lands 8 and 9, being relatively narrow, appear significantly inductive at the operating frequency; one skilled in the art can determine the physical dimensions of lands 8 and 9 so that their inductance has the requisite value to tune out the capacitive junction reactance of diode 7, thus improving the match to the microwave signal and optimizing the sensitivity of the detector. The antenna of the present invention thus functions synergistically as an antenna, a detector, and an impedance matching transformer for matching the antenna to the detector.

Also connected to the center of the patch is land 6, used as a transmission line to conduct detected signal to the edge of substrate 2 for connection to other circuitry in the ESL. Land 6, being elongate and relatively narrow, presents a high impedance suitable for input to a high-impedance transmission line connecting to circuits with high-impedance input, or for connection directly to a high-impedance input of subsequent circuitry without an intermediate transmission line. Such subsequent circuitry may be mounted on the same substrate if desired.

The subsequent circuitry may include means for toggling the bias on the diode so as to toggle the diode on and off. This will have the effect of toggling the antenna in and out of reflective mode, and may be used to effect backscatter modulation—the aforementioned transmitter might command a particular ESL to send back information; the transmitter would then transmit a CW signal and the ESL would reflect a signal modulated with digital information.

Figure 3:
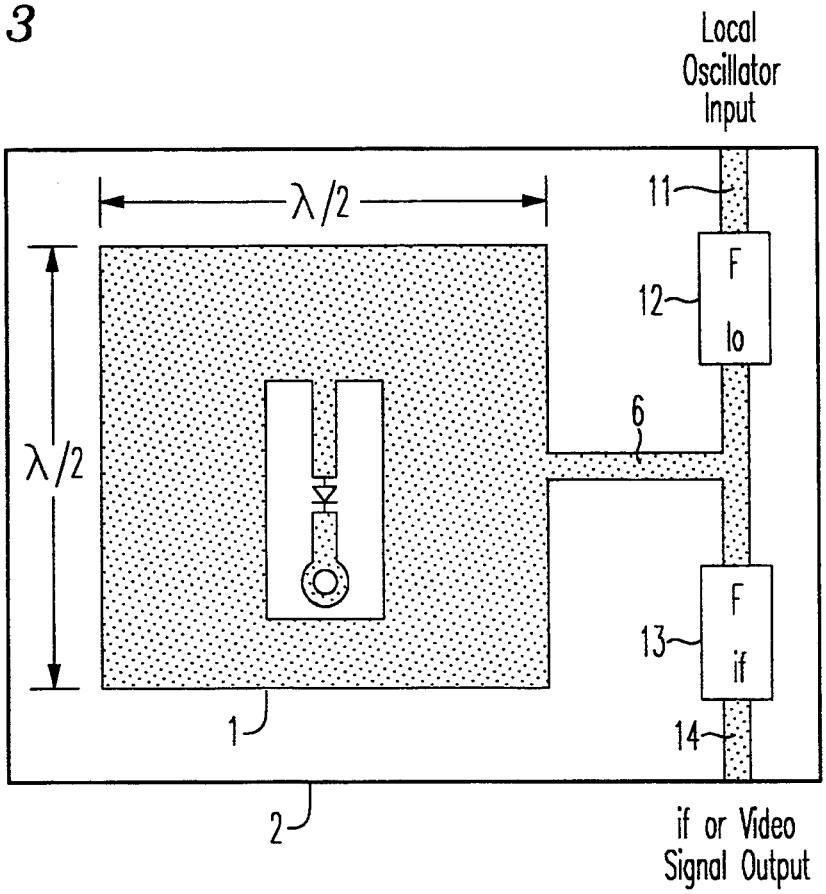
FIG. 3 depicts an embodiment of the present invention adapted for use as a mixer, if detector, or af detector.

Another embodiment of the invention, adapted for use as a mixer or if or af detector, is shown in FIG. 3. A square patch 1 is printed on a face of substrate 2. Each side of the patch is a half-wavelength at the intended operating frequency of 5.8 GHz. (As is known to those in the art, the wavelength in a conductive structure may be slightly different than the wavelength in free space.) Within the patch there is a "slot" or "window"—an area of no metallization. Analogously to the embodiment of FIG. 2, land 8 protrudes into the slot and is electrically continuous with patch 1; land 9, not electrically continuous with patch 1, is provided with via 10 connecting to the grounded foil on the other face of substrate of 2; diode 7 is connected between lands 8 and 9.

Lands 11 and 14 are not electrically continuous with patch 1 or land 6. A local oscillator signal is input to land 11; through a microstrip bandpass filter 12 (known in the prior art) it is applied to patch 1 through land 6 where it heterodynes with the rectified signal produced by diode 7. (Land 6 connects to patch 1 at point where the electric field has a null at the resonant frequency of 5.8 GHz.) The heterodyned signal is passed through microstrip if lowpass filter 13 to land 14 for connection to other circuitry of the ESL.

If the local oscillator input has a frequency of $\omega_p$, the output signal will have a frequency $$\omega_{if}=\omega_s-\omega_p$$

where $\omega_s$ is the received signal frequency (5.8 GHz in the contemplated application).

Alternatively, the configuration of FIG. 3 may be adapted for use as a video detector by removing local oscillator bandpass filter 12 (in which case land 11 would be electrically continuous with land 6) and using an antiparallel diode pair in lieu of diode 7. (The diodes used in a particular embodiment were a Hewlett-Packard hp8101 and a Macom 10117B.) In this case, for a local oscillator frequency $\omega_p/2$ (not $\omega_p$), the output frequency will again be $$\omega_{if}=\omega_s-\omega_p$$

A local oscillator with a frequency of $\omega_p/2$ (e.g., 2.9 GHz. for 5.8 GHz. operation) can be simpler and cheaper than a local oscillator with a frequency of $\omega_p$.

Figure 4:
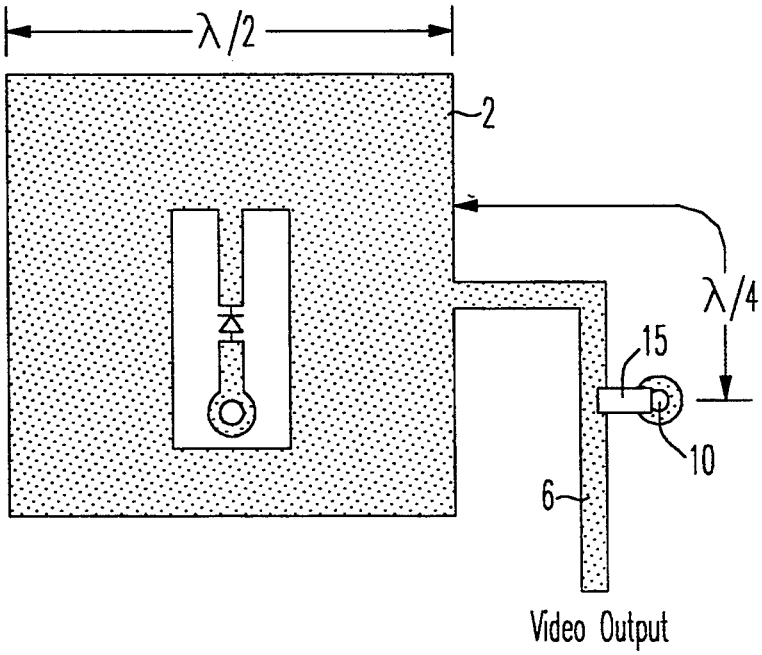
FIG. 4 depicts an embodiment of the present invention adapted for use as a video detector.

FIG. 4 depicts another embodiment of the invention, adapted for use as a video detector. An rf ground through chip capacitor 15 to via 10 is provided a quarter-wavelength away from the electric field null point (middle) of the integrated patch antenna. This rf short is transformed into an open circuit at the edge of the patch, thus minimizing leakage of rf signal energy into subsequent circuitry of the ESL.

Figure 5:
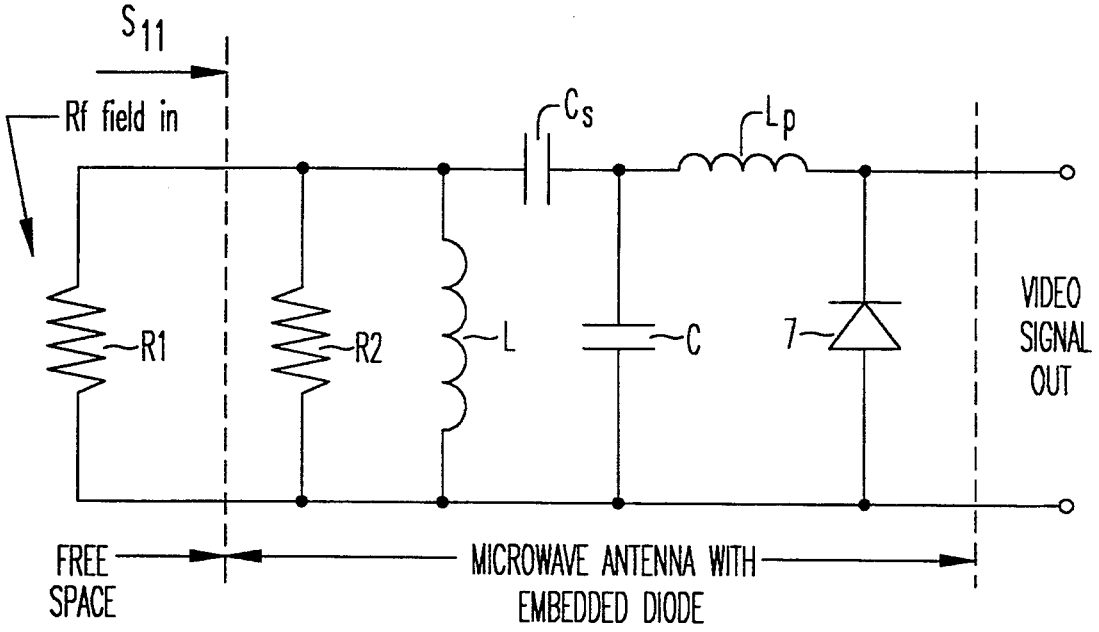
FIG. 5 is a lumped-parameter equivalent circuit of the embodiment shown in FIG. 4.

As an aid to the understanding of the invention, FIG. 5 is a lumped equivalent circuit of the embodiment depicted in FIG. 4, with:

Resonant frequency = 5.8 GHz.
A = patch area = 1 cm. × 1 cm.
d = substrate thickness = 3.0 mm.
$\epsilon_r$ = dielectric constant of substrate = 3.0
$C_s$ = static capacitance of the patch $$C_s \approx \frac{\epsilon_0 \epsilon_r A}{d} = 10pF$$

$L = 1/\omega C = 0.15$ nH

The remaining parameters were determined from measurements made with a Hewlett-Packard network analyzer:

R1 (radiation resistance of free space, equivalent radiation resistance seen by the patch) = 90 ohms R2 = patch resistance = 980 ohms Antenna efficiency = $100\%/(1+R_1/R_2) = 90\%$ The capacitance $C_s$ prevents shorting of diode 7 through inductance L at dc. The parasitic inductance $L_p$ is caused by current crowding at the feed point and series inductance between diode 7 and patch 1 due to the short length of the connecting high-impedance microstrip line.

Diode 7 works as a half-wave rectifier of the incident rf wave; the capacitance $C_s$ is charged up to the peak value of the rf voltage. Thus the video output signal is proportional to the strength of the incident rf field.

Figure 6:
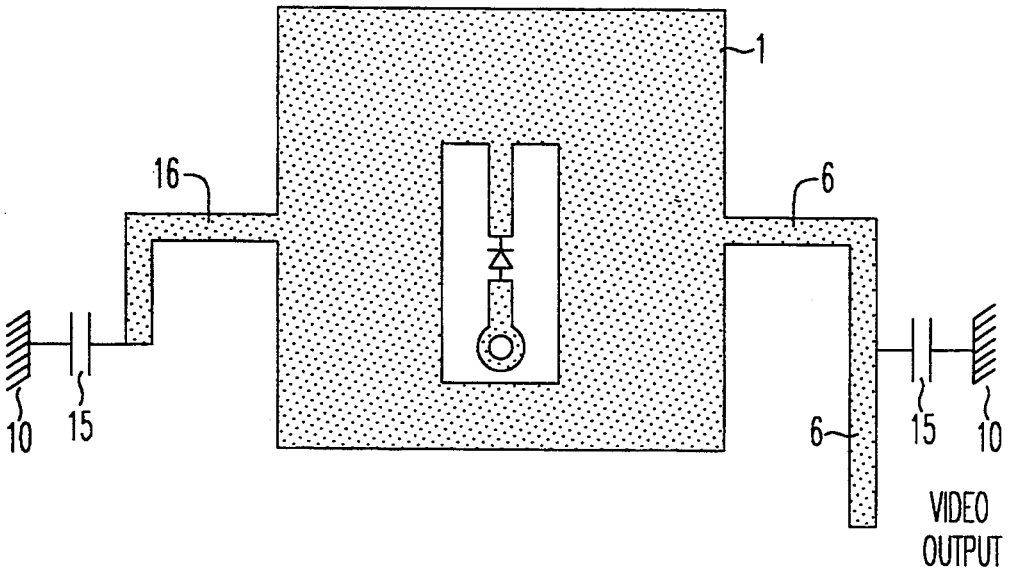
FIG. 6 depicts the embodiment of FIG. 4 further adapted to reduce spurious resonances.

The antenna as depicted in FIG. 4 can be made symmetrical to reduce spurious resonances by adding the mirror image of the quarter-wave portion of the video output line to the opposite side of the patch; such a configuration is depicted in FIG. 6. Land 6, from which the output is drawn, has chip capacitor 15 connected to ground through via 10 a quarter wavelength away from patch 1 as in FIG. 4. (They are shown in schematic form in FIG. 6, as opposed to the physical representation in FIG. 4.) Also provided is land 16, a quarter wavelength long, with another chip capacitor 15 at its outer end connected through a via 10 to ground.

Figure 7:
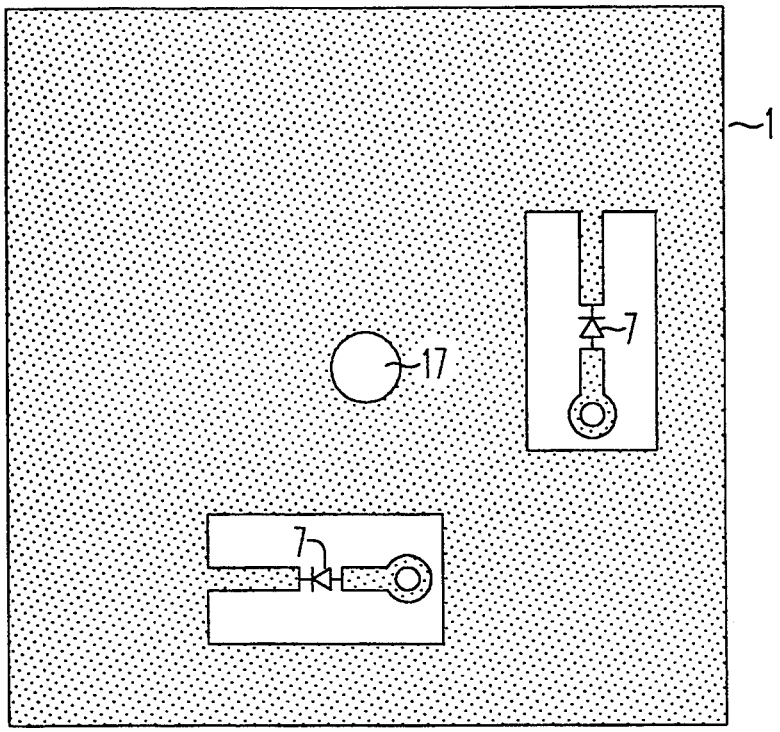
FIG. 7 shows an embodiment adapted to exhibit two resonant modes.

FIG. 7 depicts a quadratic configuration of the invention which supports two resonant modes (one for horizontally polarized signal and one for vertically polarized signal). Two slots at quadrature are deployed in patch 1, each with a diode 7. The electric field null occurs at the center of patch 1, where it may be extracted through via 17. Via 17, unlike vias 10, is not connected to the foil 3 on the other face of substrate 2 (not shown in FIG. 7).

If patch 1 is square, each side equal to a half-wavelength at the desired operating frequency, the antenna will respond to either horizontally or vertically polarized signal at that frequency. If patch 1 is rectangular, with its length slightly greater than a half-wavelength and its width slightly less than a half-wavelength, the antenna will respond to circularly-polarized signals.

Alternatively, the patch may be rectangular with its length and width markedly different. In this case the antenna will respond to one polarization of signal at a frequency determined by the patch length, and to the other polarization of signal at a frequency determined by the patch width.

Figure 8:
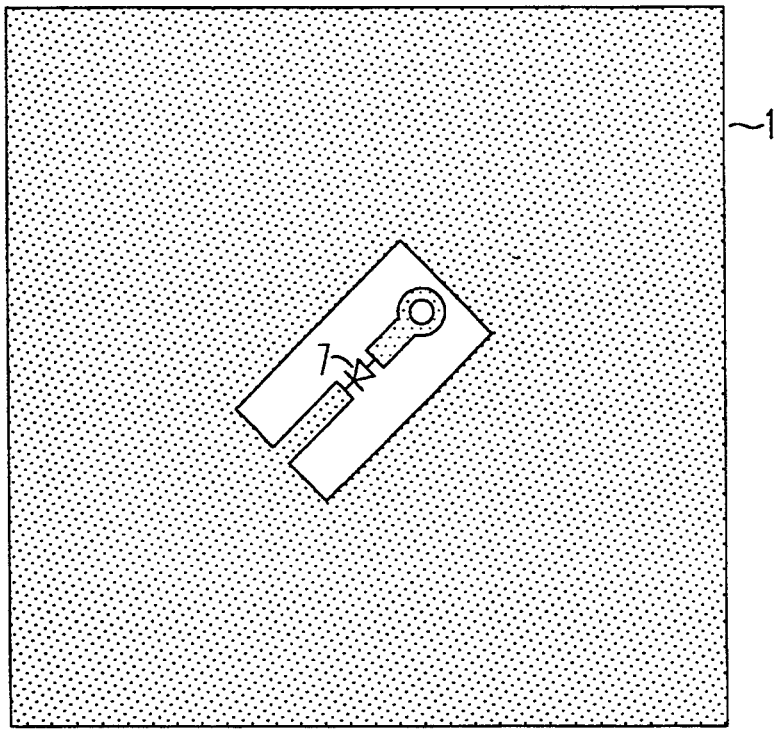
FIG. 8 shows an alternative embodiment adapted to exhibit two resonant modes.

The embodiment in FIG. 8 represents another technique for obtaining two resonant modes: creating a perturbation in the patch 1, in this case by excising one of the corners. Such techniques have been used for constructing related resonant structures, such as microstrip bandpass filters. It has been found that best operation occurs when diode 7 is connected to patch 1 along a diagonal of the latter. The perturbation thus introduced may eliminate the need for the corner excision or any other such edge disturbances.

The invention may be embodied in other specific forms without departing from the spirit thereof. The invention is intended to be embraced by the appended claims and not limited by the foregoing embodiments.

What is claimed is:

1. In an antenna comprising a resonant conductive patch proximate to but insulated from a conductive ground plane:

a detector comprising a diode having a first electrode connected to the ground plane and having a second electrode connected to the patch: and signal conducting means for conducting signal to or from the patch, the antenna being intended for use at a particular wavelength;

said signal conducting means having a length substantially greater than one-quarter of the particular wavelength; and a first capacitor having two terminals has a first terminal connected to the signal conducting means at a point one-quarter of the particular wavelength from the patch and a second terminal connected to the ground plane;

whereby radio-frequency energy of wavelengths other than said particular wavelength is conducted to ground.

2. The antenna of claim 1 wherein further:

the signal conducting means connects to a first point on the periphery of the patch;

a second conducting means connects to a second point on the periphery of the patch, said second point being opposite to said first point;

said second conducting means has a length of one-quarter of the particular wavelength;

a second capacitor having two terminals has a first terminal connected to the second conducting means at the end thereof furthest from the patch and a second terminal connected to the ground plane.

3. In an antenna comprising a resonant conductive patch proximate to but insulated from a conductive ground plane:

a detector comprising a diode having a first electrode connected to the ground plane and having a second electrode connected to the patch; and signal conducting means for conducting signal to or from the patch, the antenna being intended for use at a frequency designated $f_s$;

a local oscillator signal at a frequency designated $f_{lo}$ is input to the signal conducting means through a bandpass filter which passes the frequency $f_{lo}$; and signal output is drawn from the signal conducting means through a bandpass filter which passes the frequency $f_s \pm f_{lo}$.

4. In an antenna comprising a resonant conductive patch proximate to but insulated from a conductive ground plane:

a detector comprising a diode having a first electrode connected to the ground plane and having a second electrode connected to the patch; and signal conducting means for conducting signal to or from the patch, the antenna being intended for use at a frequency designated $f_s$;

a local oscillator signal at a frequency designated $f_{lo}$ is input to the signal conducting means; and signal output is drawn from the signal conducting means through a bandpass filter which passes the frequency $f_s \pm 2f_{lo}$.

5. In an antenna comprising a resonant conductive patch proximate to but insulated from a conductive ground plane:

a detector comprising a diode having a first electrode connected to the ground plane and having a second electrode connected to the patch; and signal conducting means for conducting signal to or from the patch, the diode possesses an inherent junction capacitance;

the patch includes a first portion of such size as to be resonant at a desired frequency and a second portion electrically continuous with the first portion, the second portion being narrow relative to the first portion; and the second electrode of the diode is connected to the patch at a point on the second portion some distance from the first portion, whereby inductance of the second portion along said distance tunes out the junction capacitance of the diode, the antenna being intended for use at a particular wavelength;

said signal conducting means having a length substantially greater than one-quarter of the particular wavelength; and a first capacitor having two terminals has a first terminal connected to the signal conducting means at a point one-quarter of the particular wavelength from the patch and a second terminal connected to the metal on the second face of the substrate, whereby radio frequency energy of wavelengths other than said particular wavelength is conducted to ground.

6. The antenna of claim 5 wherein further:

the signal conducting means connects to a first point on the periphery of the patch;

a second conducting means connects to a second point on the periphery of the patch, said second point being opposite to said first point;

said second conducting means has a length of one-quarter of the particular wavelength;

a second capacitor having two terminals has a first terminal connected to the second conducting means at the end thereof furthest from the patch and a second terminal connected to the metal on the second face of the substrate.

7. In an antenna comprising a resonant conductive patch proximate to but insulated from a conductive ground plane:

a detector comprising a diode having a first electrode connected to the ground plane and having a second electrode connected to the patch; and signal conducting means for conducting signal to or from the patch, the diode possesses an inherent junction capacitance;

the patch includes a first portion of such size as to be resonant at a desired frequency and a second portion electrically continuous with the first portion, the second portion being narrow relative to the first portion; and the second electrode of the diode is connected to the patch at a point on the second portion some distance from the first portion, whereby inductance of the second portion along said distance tunes out the junction capacitance of the diode, the antenna being intended for use at a frequency designated $f_s$;

a local oscillator signal at a frequency designated $f_{lo}$ is input to the signal conducting means through a bandpass filter which passes the frequency $f_{lo}$; and signal output is drawn from the signal conducting means through a bandpass filter which passes the frequency $f_s \pm f_{lo}$.

8. In an antenna comprising a resonant conductive patch proximate to but insulated from a conductive ground plane:

a detector comprising a diode having a first electrode connected to the ground plane and having a second electrode connected to the patch; and signal conducting means for conducting signal to or from the patch, the diode possesses an inherent junction capacitance;

the patch includes a first portion of such size as to be resonant at a desired frequency and a second portion electrically continuous with the first portion, the second portion being narrow relative to the first portion; and the second electrode of the diode is connected to the patch at a point on the second portion some distance from the first portion, whereby inductance of the second portion along said distance tunes out the junction capacitance of the diode, the antenna being intended for use at a frequency designated $f_s$;

a local oscillator signal at a frequency designated $f_{lo}$ is input to the signal conducting means; and signal output is drawn from the signal conducting means through a bandpass filter which passes the frequency $f_s \pm 2f_{lo}$.

* * * * *